US009316440B2

(12) United States Patent
Kim et al.

(10) Patent No.: US 9,316,440 B2
(45) **Date of Patent: *Apr. 19, 2016**

(54) LAUNDRY TREATMENT APPARATUS

(71) Applicant: LG Electronics Inc., Seoul (KR)

(72) Inventors: Jeongyun Kim, Seoul (KR); Sangik Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 135 days.

This patent is subject to a terminal disclaimer.

(21) Appl. No.: 14/138,746

(22) Filed: Dec. 23, 2013

(65) Prior Publication Data

US 2014/0182155 A1 Jul. 3, 2014

(30) Foreign Application Priority Data

Dec. 31, 2012 (KR) ..... 10-2012-0157984

(51) Int. Cl.
*D06F 58/20* (2006.01)
*F26B 21/00* (2006.01)
*D06F 58/22* (2006.01)

(52) U.S. Cl.
CPC ..... *F26B 21/003* (2013.01); *D06F 58/22* (2013.01)

(58) Field of Classification Search
CPC ..... D06F 5/00; D06F 58/12; D06F 58/20; F26B 19/00; F26B 21/00; F26B 21/06
USPC ..... 34/595, 601, 606, 610; 68/5 C, 5 R, 19, 68/20; 8/137, 149, 159
See application file for complete search history.

(56) References Cited

U.S. PATENT DOCUMENTS

| | | | | |
|---|---|---|---|---|
| 8,156,659 | B2 | 4/2012 | Jung | |
| 8,627,580 | B2 * | 1/2014 | Kim et al. | 34/601 |
| 8,667,705 | B2 * | 3/2014 | Shin et al. | 34/82 |
| 8,869,421 | B2 * | 10/2014 | Kim et al. | 34/381 |
| 9,052,142 | B2 * | 6/2015 | Kim et al. | |
| 2007/0107251 | A1 * | 5/2007 | Goldberg et al. | 34/82 |
| 2008/0196268 | A1 | 8/2008 | Jung | |
| 2011/0154587 | A1 | 6/2011 | Kim | |
| 2011/0271543 | A1 | 11/2011 | Kim | |
| 2012/0084992 | A1 | 4/2012 | Shin | |

FOREIGN PATENT DOCUMENTS

| | | | |
|---|---|---|---|
| CN | 1088480 | A | 6/1994 |
| DE | 10 2008 009780 | A1 | 8/2008 |
| EP | 2146000 | A1 | 1/2010 |
| EP | 2 341 182 | A1 | 7/2011 |
| EP | 2458070 | A1 * | 5/2012 |

OTHER PUBLICATIONS

European Search Report dated Apr. 1, 2014 for Application No. 13199454.3, 7 pages.
Office Action dated Aug. 21, 2015 from corresponding Chinese Patent Application No. 201310752297.2, 13 pages.

* cited by examiner

*Primary Examiner* — Stephen M Gravini
(74) *Attorney, Agent, or Firm* — Fish & Richardson P.C.

(57) ABSTRACT

A laundry treatment apparatus includes a drum rotatably supported within a cabinet and configured to receive laundry therein, a connection duct into which air inside the drum is discharged, and a discharge duct that extends in a longitudinal direction of the drum and that is connected to the connection duct. The laundry treatment apparatus also includes a filter assembly including a filter unit located in the discharge duct to filter air and an impurity remover unit configured to remove and compress impurities remaining on the filter unit.

31 Claims, 14 Drawing Sheets

(a)

(b)

(a)

(b)

LAUNDRY TREATMENT APPARATUS

Pursuant to 35 U.S.C. §119(a), this application claims the benefit of Korean Patent Application No. 10-2012-0157984, filed on Dec. 31, 2012, which is hereby incorporated by reference as if fully set forth herein.

FIELD

The present disclosure relates to a laundry treatment apparatus.

BACKGROUND

A laundry treatment apparatus is a generic term of home appliances including a washing machine for washing laundry, a dryer for drying laundry, and a combined drying and washing machine for both washing and drying laundry.

In addition, a laundry treatment apparatus capable of drying laundry (e.g., washed clothing) may be classified into an exhaust type laundry treatment apparatus and a circulation type laundry treatment apparatus.

More specifically, a laundry treatment apparatus may be classified into the exhaust type laundry treatment apparatus which is configured to exhaust hot and humid air discharged from a drum to the outside of the laundry treatment apparatus, and the circulation type laundry treatment apparatus that uses a heat exchanger that implements condensation and heating of air discharged from the drum while hot and humid air discharged from the drum is resupplied into the drum (e.g., during circulation of air discharged from the drum).

The air discharged from the drum during drying may contain impurities (e.g., lint, etc.) dropped from an object to be dried, such as laundry. Accumulation of the impurities on internal components of the laundry treatment apparatus may cause breakdown of the laundry treatment apparatus, and the impurities discharged outward from the laundry treatment apparatus may cause air contamination of an indoor space where the laundry treatment apparatus is placed. Therefore, laundry treatment apparatus having a drying function may remove the impurities from the air discharged from the drum.

A laundry treatment apparatus having a drying function may include a connection duct arranged in a height direction of a drum, and a discharge duct arranged in a longitudinal direction of the drum. The connection duct may be provided with a filter to filter air discharged from the drum.

SUMMARY

In one aspect, a laundry treatment apparatus includes a cabinet defining an external appearance of the laundry treatment apparatus, a drum rotatably supported within the cabinet and configured to receive laundry therein, and a connection duct into which air inside the drum is discharged. The laundry treatment apparatus also includes a discharge duct that extends in a longitudinal direction of the drum and that is connected to the connection duct. The laundry treatment apparatus further includes a filter assembly including a filter unit located in the discharge duct and configured to filter air, and an impurity remover unit configured to remove impurities remaining on the filter unit and compress impurities removed from the filter unit. In addition, the laundry treatment apparatus includes a drive unit configured to reciprocate the impurity remover unit along the filter unit.

Implementations may include one or more of the following features. For example, the cabinet may have a filter insertion hole that communicates with the discharge duct and the filter assembly may pass through the filter insertion hole based on the filter assembly being inserted into the discharge duct or separated from the discharge duct. In this example, the filter assembly may include a housing in which the impurity remover unit is received. The housing may be configured to store impurities removed from the filter unit by the impurity remover unit.

In some implementations, the filter unit may include a filter frame located at an upper side of the housing, an air introduction hole defined in the filter frame and configured to allow air introduced into the discharge duct to be introduced into the housing and a filter attached to the filter frame and configured to filter air moving from the housing to the discharge duct. In these implementations, the impurity remover unit may include a compressor located within the housing and configured to compress impurities within the housing by reciprocating within the housing based on force generated by the drive unit and a brush secured to the compressor and configured to separate, from the filter, impurities remaining on the filter. Further, in these implementations, the impurity remover unit may include a rack arranged in a longitudinal direction of the housing and connected to the compressor and the drive unit may include a rack gear rotatably coupled to the filter frame and engaged with the rack, and a motor gear located in the discharge duct and separably coupled to the rack gear.

The filter assembly may include a rack retraction preventing member located in the housing and configured to guide the rack in a manner that prevents the rack from being retracted outward from the housing during movement of the compressor. The rack may include a first rack and a second rack respectively provided at opposite ends of the compressor and the rack gear may include a first rack gear rotatably supported at the filter frame and engaged with the first rack, a second rack gear rotatably supported at the filter frame and engaged with the second rack, and a connection shaft configured to connect the first rack gear and the second rack gear to each other. The motor gear may be secured to a motor rotating shaft that is rotated by a motor. The motor may be located at an exterior of the discharge duct and the motor gear may be located within the discharge duct.

In addition, the filter frame may include a first frame having the air introduction hole and a second frame rotatably coupled to the first frame via the connection shaft. The second frame may be separable from the housing. Further, the compressor may include a compression plate configured to reciprocate within the housing and a plurality of through-holes perforated in the compression plate. The brush may be secured to the compression plate.

In some examples, the filter assembly may include a scraper located at the filter frame and configured to separate impurities from the brush. In these examples, the filter assembly may include a rib configured to support the filter, the scraper may have a plurality of scraper bosses protruding from the rib and spaced apart from one another by a predetermined distance, and the brush may have a plurality of brush bosses protruding from the compressor toward the filter and spaced apart from one another by a predetermined distance. In addition, in these examples, the plurality of brush bosses may pass through spaces between adjacent scraper bosses.

In some implementations, the apparatus may include a position sensing unit configured to sense a position of the impurity remover unit. In these implementations, the position sensing unit may include a magnetism generator secured to the impurity remover unit and a magnetism sensor configured to generate a control signal based on the magnetism generator reaching a preset position. Further, in these implementations, the filter assembly may include a housing in which the impurity remover unit is received such that impurities, removed from the filter unit by the impurity remover unit, are stored in the housing, a first hole perforated in a bottom surface of the housing, and a second hole perforated in the bottom surface of the housing and spaced apart from the first hole by a predetermined distance. The magnetism sensor may be a first magnetism sensor secured within the discharge duct at a position below the first hole and the apparatus may include a second magnetism sensor secured within the discharge duct at a position below the second hole.

In some examples, the discharge duct may include a path guide configured to guide air discharged from the connection duct to the air introduction hole and the filter assembly may include a frame guide that protrudes from an upper surface of the filter frame and contacts the path guide. In these examples, the filter assembly may include a guide slope configured to connect an upper surface of the frame guide and the upper surface of the filter frame to each other and the discharge duct may include a first duct guide configured to contact the guide slope and a second duct guide configured to contact the upper surface of the filter frame based on the filter assembly being inserted into the discharge duct.

In some implementations, the cabinet may include a rear panel having an air outlet through which air, discharged from the drum through the discharge duct, is discharged to outside of the cabinet and a base panel located below the drum. In these implementations, the rear panel may be secured to the base panel and the base panel may have a duct guide configured to guide positioning of the discharge duct in a manner that facilitates coupling of the discharge duct to the air outlet.

In some examples, the duct guide may include at least one position guide configured to guide both lateral sides of the discharge duct to coincide with both lateral sides of the air outlet and at least one height guide configured to guide a top and bottom of an outer peripheral surface of the discharge duct to coincide with a top and bottom of an outer periphery of the air outlet. In these examples, each of the at least one position guide and the at least one height guide includes a first plate and a second plate extending perpendicular to the first plate with the second plate having a slope, the at least one position guide includes at least one pair of position guides each secured to the base panel via the second plate, and the at least one height guide is secured to the base panel via the first plate.

In some implementations, the filter unit may include two cover frames extending from opposite ends of the filter frame and configured to receive opposite surfaces of the housing and covers located respectively at the cover frames and each being configured to define a predetermined space between the cover frame and the cover. In these implementations, the filter unit may include a connection plate slit in each of the cover frames that extends in a longitudinal direction of the housing, and the drive unit may include a first rack and a second rack, each of which is secured to the compressor through the connection plate slit and located in a space between the cover frame and the cover. The drive unit also may include a first intermediate gear rotatably coupled to a first cover frame and configured to reciprocate the first rack in a longitudinal direction of the housing and a second intermediate gear rotatably coupled to a second cover frame and configured to reciprocate the second rack in a longitudinal direction of the housing, a separable gear rotatably coupled to a first cover and configured to penetrate the first cover to thereby be engaged with the first intermediate gear, a connection shaft penetrating the first and second cover frames, a first connection gear located on the connection shaft and engaged with the first intermediate gear, and a second connection gear located on the connection shaft and engaged with the second intermediate gear. The drive unit further may include a motor secured to an exterior of the discharge duct and having a rotating shaft penetrating the discharge duct and a motor gear secured to the rotating shaft and located within the discharge duct. The separable gear may be connected to the motor gear.

In some examples, the drive unit may include a first rack gear rotatably coupled to the first cover frame and configured to connect the first intermediate gear and the first rack to each other and a second rack gear rotatably coupled to the second cover frame and configured to connect the second intermediate gear and the second rack to each other. In these examples, the first rack and the second rack may have a same configuration and the first rack may include a rack body having a shape of a bar, a geared portion protruding from a surface of the rack body and engaged with the first rack gear, and a connection plate located at the rack body and configured to be inserted into the connection plate slit to thereby be coupled to the compressor.

In some implementations, the filter unit may include a rack guide provided at each of the first and second cover frames and configured to guide movement of the first rack or the second rack. In these implementations, the rack guide may include a rack body receiving portion in which the rack body is received. The rack body receiving portion may extend from a bottom of the connection plate slit to a lower portion of the cover frame. The rack guide also may include a gear receiving portion in which the geared portion is received. The gear receiving portion extends from the rack body receiving portion toward an upper portion of the cover frame.

The rack body receiving portion may extend in a longitudinal direction of the connection plate slit and may be spaced apart from the connection plate slit by a distance equal to or less than a thickness of the rack body. Also, the rack guide may include a rack body support portion located within the rack body receiving portion and configured to contact an upper surface of each rack body.

In some examples, the filter assembly may include a housing having a storage space configured to store impurities, an air introduction hole perforated in the housing, through which air introduced into the discharge duct is introduced into the storage space through the air introduction hole, and a housing through-hole perforated in the housing, the filter unit being located at the housing through-hole. In these examples, the impurity remover unit may be rotatably supported within the housing and may be configured to separate, from the filter unit, impurities remaining on the filter unit and to compress impurities separated from the filter unit within the housing.

In some implementations, the impurity remover unit may include a brush frame located within the housing and configured to reciprocate over a predetermined area of the filter unit, the brush frame compressing impurities within the housing. In these implementations, the impurity remover unit also may include a brush located at the brush frame and configured to contact the filter unit and a brush rotating shaft configured to rotatably secure the brush frame to the housing. In addition, in these implementations, the drive unit may include a motor secured to the discharge duct, a driving gear coupled to a rotating shaft of the motor and located within the discharge duct, and a driven gear provided on the brush rotating shaft and located at an exterior of the housing so as to be engaged with the driving gear.

DETAILED DESCRIPTION

Figure 1:
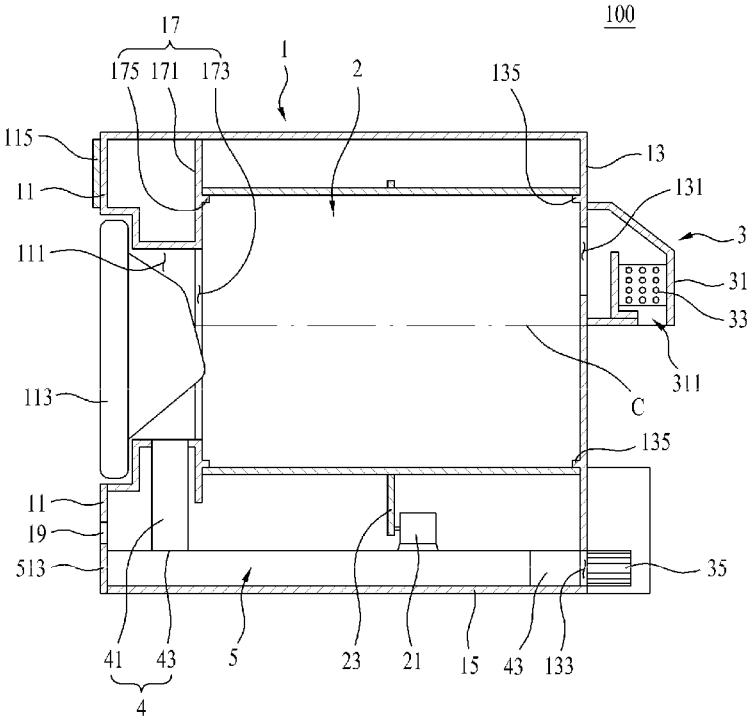
FIG. 1 is a view showing an example configuration of an example laundry treatment apparatus.

A laundry treatment apparatus 100, as shown in FIG. 1, includes a cabinet 1 defining an external appearance of the laundry treatment apparatus 100, a drum 2 rotatably placed within the cabinet 1, the drum 2 being configured to receive laundry therein, an air supply unit 3 configured to supply heated air (e.g., hot air) or unheated air into the drum 2, a discharge path 4 configured to discharge air outwardly from the drum 2, and a filter assembly 5 (see FIG. 3) configured to remove impurities from the air discharged from the drum 2.

The cabinet 1 is constituted of a front panel 11 having an opening 111, a rear panel 13 having an air inlet 131 that communicates with the interior of the drum 2, and a base panel 15 located below the drum 2. The front panel 11 and the rear panel 13 are supported by the base panel 15.

A user may put or take laundry into or out of the drum 2 through the opening 111. The opening 111 is opened or closed by a door 113 that is rotatably secured to the front panel 11.

A control panel 115 may be attached to the front panel 11. The control panel 115 is provided with an input unit that allows a user to input control instructions to the laundry treatment apparatus 100 and a display unit that displays control details of the laundry treatment apparatus 100.

The rear panel 13 is located opposite to the front panel 11 so as to face the front panel 11 (e.g., the rear panel 13 is spaced apart from the front panel 11 by a predetermined distance in a longitudinal direction of the drum 2). The air inlet 131 is perforated in the rear panel 13 to allow air supplied from the air supply unit 3 to be introduced into the drum 2.

The rear panel 13 may further have an air outlet 133, through which the air discharged from the drum 2 through the discharge path 4 moves outward from the cabinet 1.

The rear panel 13 may further have a rear support flange 135 configured to rotatably support a rear surface of the drum 2. This will be described later in more detail.

The base panel 15 serves to support the laundry treatment apparatus 100 on the ground. The front panel 11 and the rear panel 13 are secured to the base panel 15.

Figure 2:
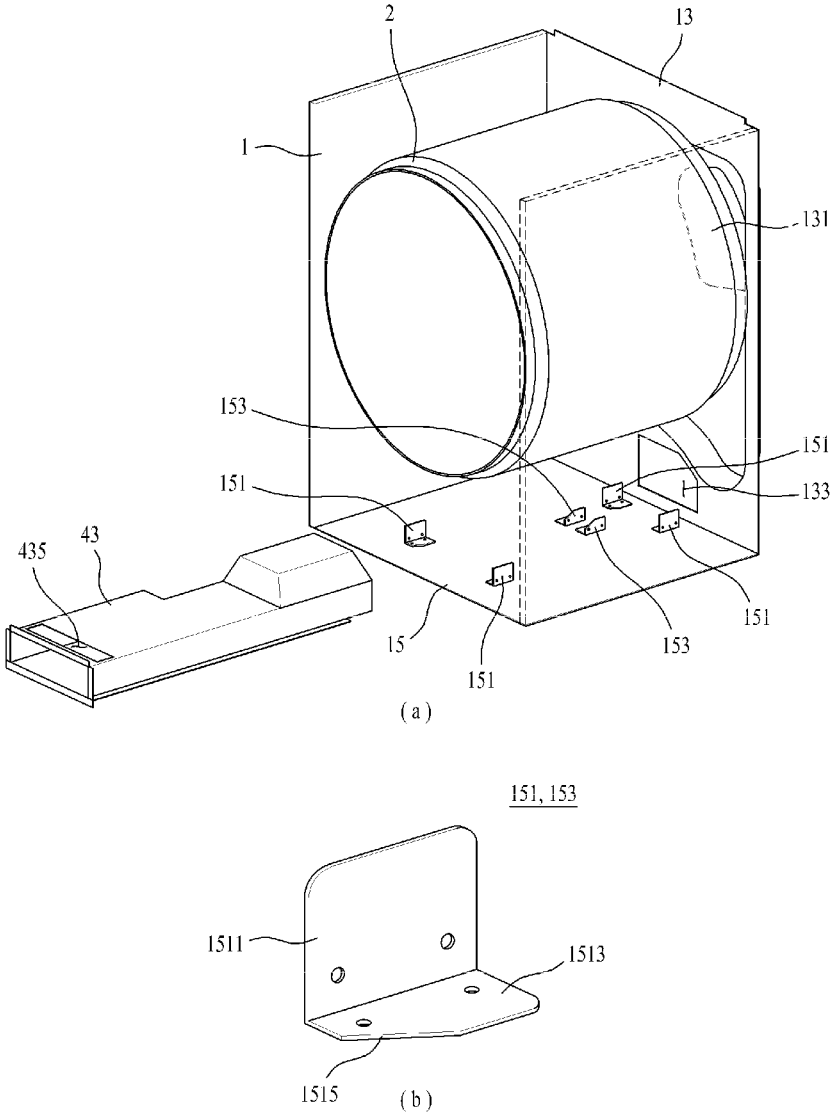
FIGS. 2(*a*) and 2(*b*) are views showing an example cabinet and an example discharge duct included in the laundry treatment apparatus.

The base panel 15 may have duct guides 151 and 153 (see FIG. 2(*a*)) configured to facilitate assembly of a discharge duct 43 provided in the discharge path 4 and the air outlet 133 perforated in the rear panel 13. This will be described later in more detail.

A drum support structure 17 is further provided within the cabinet 1 to rotatably support a front surface of the drum 2. The drum support structure 17 includes a support body 171 secured to an inner surface of the cabinet 1 and a support structure through-hole 173 perforated in the support body 171 for communication between the opening 111 and the interior of the drum 2.

Accordingly, laundry introduced into the cabinet 1 through the opening 111 may move into the drum 2 through the support structure through-hole 173.

The drum support structure 17 may further include a front support flange 175 configured to rotatably support the front surface of the drum 2. The front support flange 175 is formed at an outer periphery of the support structure through-hole 173.

In this case, the diameter of the front support flange 175 may be greater than the diameter of the support structure through-hole 173 in consideration of the diameter of the drum 2.

The drum 2 may have the shape of a cylinder, the front surface and the rear surface of which are open. As described above, the front surface of the drum 2 is rotatably supported by the front support flange 175, and the rear surface of the drum 2 is rotatably supported by the rear support flange 135.

A drum drive unit is provided to rotate the drum 2. The drum drive unit may include a drum motor 21, and a belt 23 that connects a rotating shaft of the drum motor 21 and an outer peripheral surface of the drum 2 to each other.

The air supply unit 3 serves to supply heated air or unheated air into the drum 2 to allow heat exchange between laundry and the air. The air supply unit 3 may include a heater housing 31 formed at the rear panel 13, a heater (e.g., a device configured to increase temperature of air passing through the heater housing 31) 33 accommodated in the heater housing 31, and a fan 35 located in the discharge path 4 (more particularly, located in a connection duct 41 or the discharge duct 43).

The heater housing 31 is configured to enclose the air inlet 131 perforated in the rear panel 13, and has a housing inlet 311 for introduction of air into the heater housing 31.

Providing the heater housing 31 at the exterior of the cabinet 1, rather than the interior of the cabinet 1, may increase the drying capacity of laundry.

If the quantity of laundry increases, it may be necessary to supply a greater quantity of air into the drum 2 to achieve drying of laundry within a predetermined time. Accordingly, to dry a large quantity of laundry, the laundry treatment apparatus 100 may increase the quantity of air supplied into the drum 2, and may employ a large capacity heater to heat a large quantity of air.

If the large capacity heater is placed within the cabinet 1, however, the volume of the cabinet 1 is increased. Moreover, the large capacity heater may increase an internal temperature of the cabinet 1, which may cause damage to internal components within the laundry treatment apparatus 100.

To address these issues, in the laundry treatment apparatus 100, the air supply unit 3 is secured to the exterior of the cabinet 1. As such, the laundry treatment apparatus 100 may be utilized as a commercial laundry treatment apparatus that is capable of drying large amounts of laundry per load.

The discharge path 4, as described above, serves to discharge air inside the drum 2 to the outside of the cabinet 1. The discharge path 4 may include the connection duct 41 arranged in a height direction of the drum 2, and the discharge duct 43 arranged in a longitudinal direction of the drum 2, through which air supplied from the connection duct 41 is discharged to the outside of the cabinet 1.

The connection duct 41 is located below the opening 111 (in front of the support structure through-hole 173) and serves to move air inside the drum 2 to the discharge duct 43. That is, the connection duct 41 connects an outer periphery of the opening 111 and a duct connection hole (435, see FIG. 2(*a*)) of the discharge duct 43 to each other.

The discharge duct 43 is configured to connect the connection duct 41 and the air outlet 133 to each other and serves to discharge the air discharged from the drum 2 through the connection duct 41 to the outside of the cabinet 1.

In this case, the fan 35 included in the air supply unit 3 may be secured to the exterior of the cabinet 1 to suction air from inside the discharge duct 43.

To dry a large quantity of laundry, as described above, large air volume may be used. However, it may not be easy to install a large capacity fan within the cabinet 1 having a limited volume.

Accordingly, as shown in FIG. 1, the fan 35 is secured to the rear panel 13 to outwardly discharge air inside the drum 2 through the air outlet 133, which enables installation of a large capacity fan without a change in the size of the cabinet 1.

The discharge duct 43, as shown in FIG. 2(*a*), may be first assembled with the base panel 15 located below the drum 2 after the drum 2 is assembled with the base panel 15.

In this case, for assembly of the discharge duct 43, a worker needs to push the discharge duct 43 from the front side of the drum 2 toward the rear panel 13 in order to couple the discharge duct 43 into the air outlet 133 of the rear panel 13. However, if the drum 2 obstructs a worker's field of vision, the worker may have difficulty in coupling the discharge duct 43 into the air outlet 133.

Accordingly, the base panel 15 may be provided with the duct guides 151 and 153 to facilitate coupling of the discharge duct 43 and the air outlet 133.

The duct guides may include at least one pair of position guides 151 and at least one height guide 153. The position guides 151 assist in positioning both lateral sides of the discharge duct 43 to coincide with both lateral sides of the air outlet 133, and the at least one height guide 153 assists in positioning the top and bottom of an outer peripheral surface of the discharge duct 43 to coincide with the top and bottom of an outer periphery of the air outlet 133.

Providing the position guide 151 and the height guide 153 with the same configuration may be advantageous in terms of reduction of manufacturing costs. To this end, each of the position guide 151 and the height guide 153 may include a first plate 1511 and a second plate 1513 extending perpendicular to the first plate 1511, the second plate 1513 having a slope 1515.

The position guide 151 is secured to the base panel 15 via the second plate 1513, whereas the height guide 153 is secured to the base panel 15 via the first plate 1511.

Accordingly, once the discharge duct 43 is inserted into a space defined by the pair of position guides 151, both lateral sides of the discharge duct 43 may be moved to positions where both lateral sides of the discharge duct 43 coincide with both lateral sides of the air outlet 133 under guidance of the first plates 1511 of the position guides 151.

While the discharge duct 43 is moved toward the air outlet 133, the bottom of the outer peripheral surface (e.g., a bottom surface) of the discharge duct 43 is adjustable in height by the slope 1515 of the height guide 153. In this manner, the top and bottom of the outer peripheral surface of the discharge duct 43 may coincide with the top and bottom of the outer periphery of the air outlet 133.

If the width of the discharge duct 43, as shown in FIG. 2, is not constant, the position guides 151 may include a pair of front position guides arranged on the base panel 15 at the front side of the discharge duct 43, and a pair of rear position guides arranged on the base panel 15 at the rear side of the discharge duct 43 (e.g., arranged at positions adjacent to the air outlet 133).

The filter assembly 5 included in the laundry treatment apparatus 100 is arranged in a direction parallel to the rotating axis C of the drum 2 (e.g., in a longitudinal direction of the drum 2) to filter air discharged from the drum 2.

More specifically, the filter assembly 5 included in the laundry treatment apparatus 100 is separably coupled to the discharge duct 43, rather than the connection duct 41, thereby filtering air discharged from the drum 2.

In some laundry treatment apparatus, the connection duct 41 is provided with a filter. However, the length of the connection duct 41 is not variable so long as the height of the laundry treatment apparatus is not varied, which may make it difficult to increase the filtration capacity of the filter.

The laundry treatment apparatus 100 may achieve a significant increase in the filtration capacity of the filter assembly 5 because the filter assembly 5 is provided in the discharge duct 43 extending in a longitudinal direction of the drum 2 (e.g., parallel to the rotating axis C of the drum 2).

Accordingly, the laundry treatment apparatus 100 may be utilized as a commercial laundry treatment apparatus that is capable of drying large amounts of laundry per load.

The filter assembly 5 may be separably coupled to the discharge duct 43. To this end, the front panel 11 may be provided with a filter support panel 19.

Figure 3:
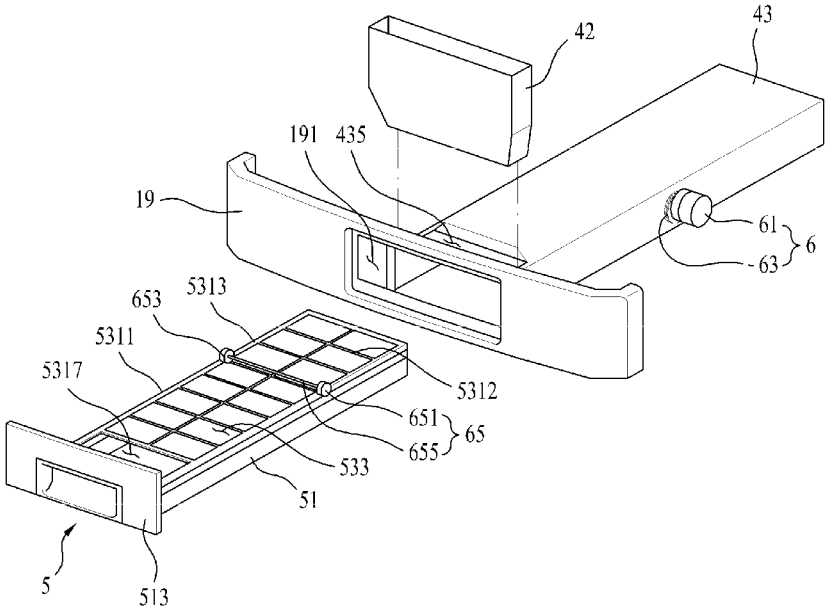
FIG. 3 is a view showing an example filter assembly and an example discharge duct included in the laundry treatment apparatus.

As shown in FIG. 3, the filter support panel 19 has a filter insertion hole 191 for insertion of the filter assembly 5. The filter support panel 19 may be located below the front panel 11 (e.g., below the door 13).

Hereinafter, a configuration of the filter assembly 5 will be described with reference to FIGS. 3 and 4.

The filter assembly 5 includes a housing 51 defining a storage space 511 in which impurities are stored. The housing 51 is configured to be inserted into the discharge duct 43 through the filter insertion hole 191 of the filter support panel 19. The housing 51 may be provided at a front surface thereof with a handle 513 to facilitate introduction and retraction of the housing 51.

The housing 51 may be a hexahedral housing, one side of which faces the connection duct 41 and is open. In this case, a filter unit 53 is located at the open side of the housing 51.

An impurity remover unit B is accommodated in the housing 51 and serves to remove impurities remaining on the filter unit 53 and compress the impurities removed from the filter unit 53 within the housing 51.

The impurity remover unit B may include a brush 57 configured to separate impurities remaining on the filter unit 53, and a compressor 55 configured to compress the impurities separated by the brush 57 within the storage space 511. This will be described later in more detail.

The filter unit 53 includes a filter frame 531 located at the open side of the housing 51 and a filter 533 secured to the filter frame 531.

The filter frame 531 has an air introduction hole 5317 communicating with the duct connection hole 435. Accordingly, the air discharged from the drum 2 through the connection duct 41 is introduced into the housing 51 through the duct connection hole 435 and the air introduction hole 5317, and, in turn, the air introduced into the housing 51 is discharged outward from the housing 51 (e.g., from the interior of the discharge duct 43) by way of the filter 533.

In this case, the discharge duct 43 may further be provided with a path guide (431, see FIG. 9) to allow air discharged from the connection duct 41 to move to the air introduction hole 5317.

The filter frame 531 may include a first frame 5311 having the air introduction hole 5317, and a second frame 5313 rotatably coupled to the first frame 5311. This structure may facilitate removal of impurities stored in the storage space 511 of the housing 51.

When removal of impurities stored in the housing 51 is needed, the user first retracts the filter assembly 5 from the discharge duct 43, and then separates the filter frame 531 from the housing 51, in order to remove impurities stored in the housing 51.

The filter assembly 5 included in the laundry treatment apparatus 100 may be designed to attempt to maximize air filtration capacity, which may result in increase in the size and weight of the housing 51. Accordingly, if the filter frame 531 is constructed by a single frame, the user may be inconvenienced by having to remove impurities within the housing 51 due to the weight of the filter assembly 5.

However, the filter frame 531 may reduce the above-described problem because the filter frame 531 includes the first frame 5311 and the second frame 5313, and the second frame 5313 is rotatably coupled to the first frame 5311 and is separable from the housing 51.

In addition, the filter frame 531 may have a rack gear receiving portion 5315 in which a rack gear 65 that will be described in more detail hereinafter is received. The rack gear receiving portion 5315 may be provided at a junction (e.g., boundary) between the first frame 5311 and the second frame 5313.

As described above, the impurity remover unit B may include the brush 57 and the compressor 55.

The brush 57 is configured to reciprocate within the housing 51 (more particularly, within the storage space 511) and serves to separate impurities remaining on the filter 533. The compressor 55 is configured to reciprocate within the housing 51 and serves to compress impurities stored in the storage space 511.

Figure 4:
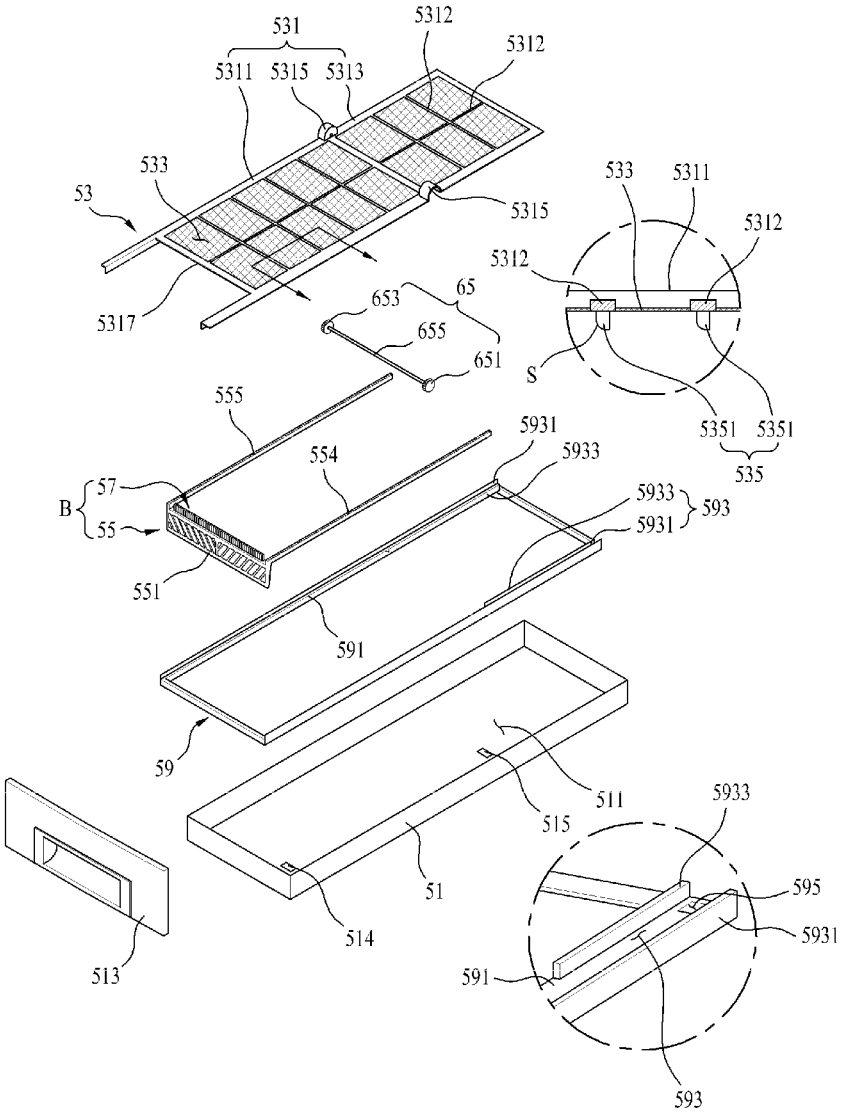
FIG. 4 is an exploded perspective view of an example filter assembly included in the laundry treatment apparatus.

Accordingly, if the brush 57 is located at an upper surface of the compressor 55 to come into contact with the filter 533 as shown in FIG. 4, both the brush 57 and the compressor 55 may be operated using only a single drive unit 6 (e.g., brush drive unit) that serves to reciprocate the brush 57 within the storage space 511.

The compressor 55 may include a compression plate 551 placed within the housing 51, and a first rack 554 and a second rack 555 located respectively at opposite ends of the compression plate 551.

Each of the first rack 554 and the second rack 555 may include a bar-shaped body and gears protruding from the body at a constant interval.

In this case, a rack guide 59 is provided in the open side of the housing 51 to guide movement of the racks 554 and 555.

That is, the rack guide 59 is interposed between the filter frame 531 and the housing 51 and serves to guide movement of the first rack 554 and the second rack 555.

To this end, the rack guide 59 may include a guide body 591 supported by the open upper side of the housing 51, and rack receiving portions 593 protruding from an upper surface of the guide body 591 to enable seating of the first rack 554 and the second rack 555 on the rack guide 59.

Each of the rack receiving portions 593 may include a first guide plate 5931 formed at a longitudinal outer edge of the guide body 591, and a second guide plate 5933 spaced apart from the first guide plate 5931 by a sufficient distance to receive the first rack 554 or the second rack 555.

The second guide plate 5933 may not extend throughout the longitudinal length of the guide body 591, but may be formed only at a portion of the guide body 591.

The second guide plate 5933 may restrict movement of the compressor 55 past the portion of the guide body 591 over which the second guide plate 5933 extends, thereby determining the quantity of impurities to be compressed by the filter assembly 5 via the second guide plate 5933.

The impurities, separated from the filter 533 by the brush 57, are moved by the compression plate 551 in a given direction from the air introduction hole 5317 (e.g., from the front side of the housing 51) toward the air outlet 133 (e.g., toward the rear side of the housing 51) located opposite to the air introduction hole 5317 until the impurities reach a position of the second guide plate 5933.

Accordingly, the impurities within the housing 51 are compressed and stored in a rear space of the housing 51 corresponding to the length of the second guide plate 5933 by the compression plate 551. The size of the rear space of the housing 51 corresponding to the length of the second guide plate 5933 may determine the maximum storage quantity of impurities of the filter assembly 5 (e.g., the maximum storage quantity of impurities to prevent deterioration of drying efficiency).

Whether or not the quantity of impurities within the housing 51 exceeds the predetermined maximum storage quantity is judged via a storage quantity sensing unit. This will be described later in more detail.

Figure 5:
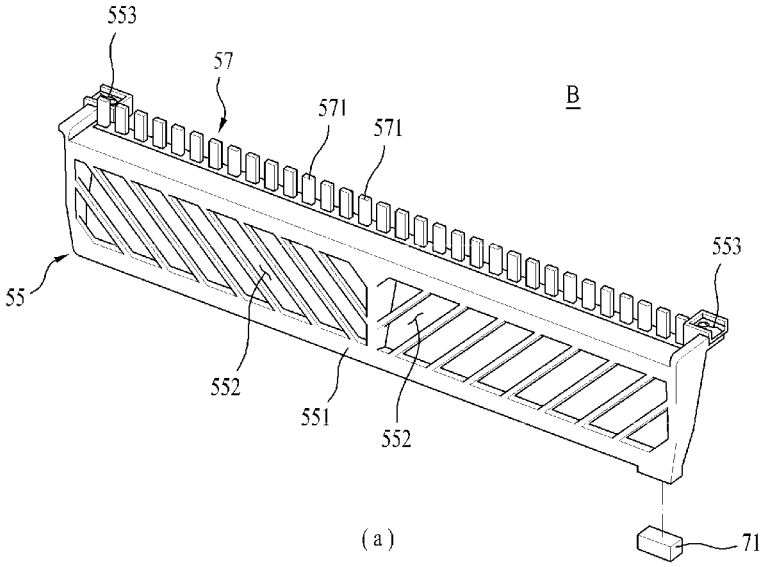
FIGS. 5(*a*) and 5(*b*) are views showing an example impurity remover unit included in the laundry treatment apparatus.
Figure 5:
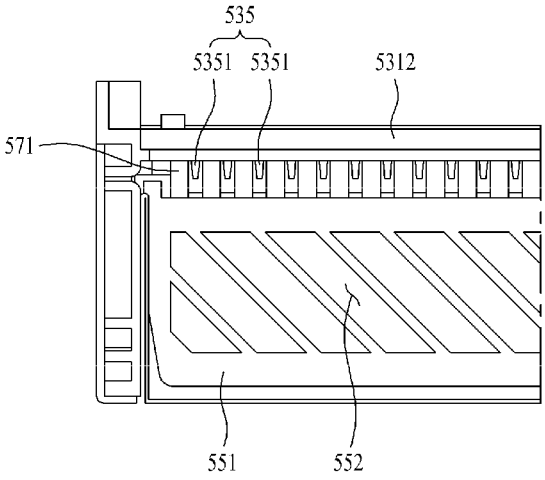

The compressor 55, as shown in FIGS. 5(*a*) and 5(*b*), may further include a plurality of through-holes 552 perforated in the compression plate 551. The through-holes 552 serve to reduce (e.g., prevent) reduction in flow rate due to the compression plate 551.

Since the compression plate 551 is configured to reciprocate within the housing 51, the compression plate 551 may prevent air, introduced into the housing 51 through the air introduction hole 5317, from moving rearward of the housing 51 if the compression plate 551 is not provided with the through-holes 552. Therefore, the air filtration capacity of the filter assembly 5 may be reduced by the compression plate 551.

In addition, if the compression plate 551 has no through-holes 552, the compression plate 551 may fail to implement normal reciprocation due to resistance of air introduced into the housing 51, and may cause overload of the drive unit 6.

The through-holes 552 of the compression plate 551 may reduce (e.g., prevent) the above-described problems.

The compression plate 551 may further be provided at opposite ends thereof with rack connection recesses 553 into which the first rack 554 and the second rack 555 are fitted respectively.

The brush 57 may have a plurality of brush bosses 571 arranged on an upper surface of the compression plate 551.

In this case, the filter frame 531 may further be provided with a scraper 535 to separate impurities from the brush 57.

The filter frame 531 may have a plurality of ribs 5312 configured to support the filter 533. The scraper 535 may include a plurality of scraper bosses 5351 protruding from the ribs 5312.

The plurality of brush bosses 571 may be arranged at a predetermined interval on the upper surface of the compression plate 551. The respective brush bosses 571 may be arranged to pass each space between adjacent scraper bosses 5351.

More specifically, the plurality of brush bosses 571 may be spaced apart from one another so as to pass each space between one scraper boss 5351 and another scraper boss 5351 when the brush 57 reciprocates within the storage space 511.

This serves to prevent the brush bosses 571 from coming into contact with the scraper bosses 5351 and from hindering movement of the compression plate 551 when the compression plate 551 reciprocates within the storage space 511.

In other examples in which the scraper bosses 5351 are configured to come into contact with the brush bosses 571, in order to prevent the scraper bosses 5351 from hindering movement of the compressor 55 to the maximum extent, each scraper boss 5351 may have a scraper slope S (see FIG. 4) formed at a side thereof facing the air introduction hole 5317.

The compressor 55 and the brush 57 as described above are adapted to reciprocate within the storage space 511 by the drive unit 6.

Figure 6:
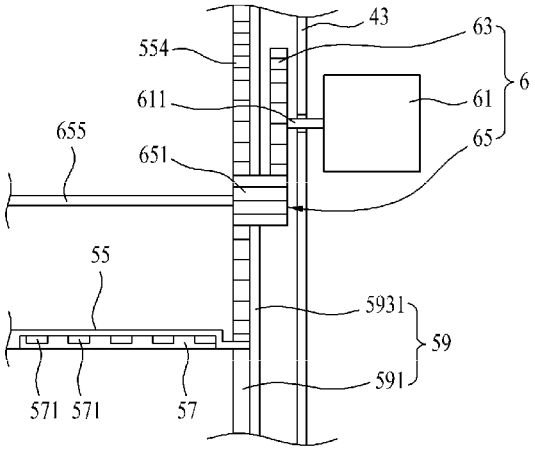
FIG. 6 is a view showing an example drive unit included in the laundry treatment apparatus.

As shown in FIG. 6, the brush drive unit 6 may include a motor 61 (e.g., brush motor) secured to the exterior of the discharge duct 43, a motor gear 63 located within the discharge duct 43, and a rack gear 65 (see FIG. 4) located in the rack gear receiving portion 5315 to enable rotation of the first and second racks 554 and 555.

Although the motor 61 may be placed within the discharge duct 43, providing the motor 61 at the exterior of the discharge duct 43 may be advantageous in terms of repair and maintenance.

In the case in which the motor 61 is secured to the exterior of the discharge duct 43, the motor gear 63 may be coupled to a rotating shaft 611 of the motor 61 penetrating the discharge duct 43.

The rack gear 65 may include a first rack gear 651 and a second rack gear 653 respectively received in a pair of rack gear receiving portions 5315 of the frame 531. The first rack gear 651 and the second rack gear 653 may be connected to each other via a connection shaft 655.

If a great quantity of impurities is stored in the storage space 511 or remains on the filter 533, the compressor 55 or the brush 57 may be affected by large resistance during reciprocation thereof. Therefore, provision of only one rack gear may cause difficulty in removing the impurities from the filter 533 and compressing the removed impurities within the storage space 511.

For example, as the first rack gear 651 and the second rack gear 653 are connected to each other via the connection shaft 655, and the first rack gear 651 and the second rack gear 653 are respectively engaged with the first rack 554 and the second rack 555, the drive unit 6 may stably transmit power to the brush 57 and the compressor 55, even if only one of the first rack gear 651 and the second rack gear 653 is connected to the motor gear 63.

As shown in FIGS. 3 and 6, a distance between the filter insertion hole 191 and the rack gears 651 and 653 may be less than a distance between the filter insertion hole 191 and the motor gear 63.

This serves to allow one of the rack gears 651 and 653 to be separated from the motor gear 63 when the filter assembly 5 is retracted from the discharge duct 43 and to allow one of the rack gears 651 and 653 to be connected to the motor gear 63 when the filter assembly 5 is inserted into the discharge duct 43.

The connection shaft 655 may function as a hinge shaft that rotatably connects the first frame 5311 and the second frame 5313 of the filter frame 531 to each other.

In this case, the user may remove impurities stored in the housing 51 by opening the second frame 5313. Accordingly, as compared to the case in which the first frame 5311 and the second frame 5313 of the filter unit 53 are integrated with each other, it may be possible to more easily remove the impurities stored in the housing 51.

The laundry treatment apparatus 100 may further include a storage quantity sensing unit that judges the quantity of impurities stored in the storage space 511 of the housing 51.

The storage quantity sensing unit may have any configuration suitable to sense the quantity of impurities within the storage space 511.

Figure 7:
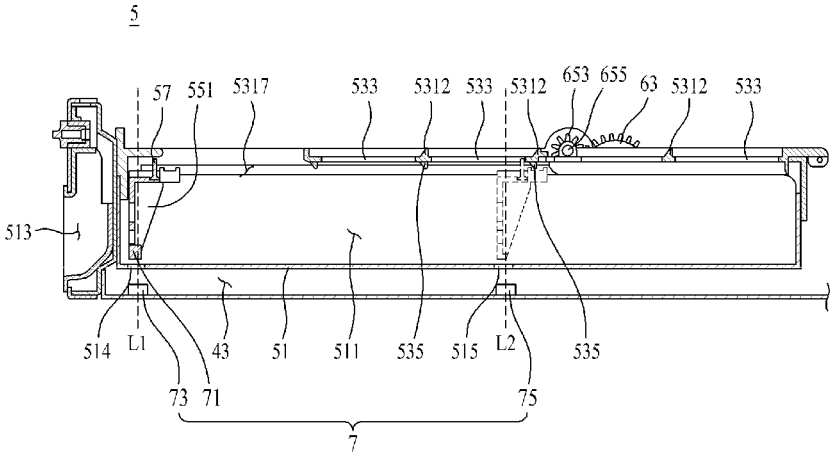
FIG. 7 is a sectional view showing an example filter assembly included in the laundry treatment apparatus.

FIG. 7 shows an example of a storage quantity sensing unit that is adapted to sense a position of the compressor 55 or the brush 57 upon operation of the drive unit 6, thereby judging the quantity of impurities stored in the storage space 511. The storage quantity sensing unit will hereinafter be referred to as a position sensing unit 7.

The position sensing unit 7 may include a magnetism generator 71 provided at the compressor 55 or the brush 57, and at least two magnetism sensors 73 and 75 adapted to sense a position of the magnetism generator 71.

As shown in FIG. 7, if the magnetism generator 71 is provided at the compressor 55, the magnetism sensors 73 and 75 may be fixed within the discharge duct 43 to sense the magnetism generator 71 through holes 514 and 515 perforated in a bottom surface of the housing 51 defining the storage space 511.

The magnetism generator 71 may be a permanent magnet or an electromagnet. The magnetism sensors 73 and 75 may be reed switches that generate an ON-OFF control signal using magnetism provided by the magnetism generator 71 to transmit the control signal to the controller.

The magnetism sensors may include a first magnetism sensor 73 that senses whether or not the compressor 55 is located at a preset initial position (e.g., a first reciprocation threshold position L1 of the compressor 55), and a second magnetism sensor 75 that judges whether or not the storage quantity of impurities exceeds a preset storage quantity (e.g., whether or not the compressor 55 is movable to a second reciprocation threshold position L2).

The initial position may be set to any position within the housing 51 so long as the compressor 55 does not hinder flow of air introduced into the filter assembly 5 through the air introduction hole 5317. FIG. 7 shows the case in which the initial position is set to the front surface of the housing 51 (e.g., a surface of the housing 51 where the handle 513 is located, or a space between the air introduction hole 5317 and the handle 513).

Once the filter assembly 5 is inserted into the discharge duct 43, the first magnetism sensor 73 and the magnetism generator 71 may face each other through the first hole 514 perforated in the bottom surface of the housing 51.

The second magnetism sensor 75 is positioned to judge the maximum quantity of impurities that may be stored in the housing 51.

The maximum quantity of impurities that may be stored in the housing 51 may be set to a position where drying efficiency is deteriorated. If movement of the compressor 55 or the brush 57 is restricted by the second guide plate 5933, the second magnetism sensor 75 may be located at the same position as a front edge of the second guide plate 5933 facing the air introduction hole 5317.

Accordingly, the controller may check whether or not the first magnetism sensor 73 senses the magnetism generator 71 before operation of the laundry treatment apparatus 100, thereby checking whether or not the brush 57 or the compressor 55 is located at an initial position and whether or not the filter assembly 5 is mounted in the discharge duct 43.

In addition, the controller may check whether or not the second magnetism sensor 75 senses the magnetism generator 71, thereby judging a removal time of impurities stored in the filter assembly 5.

Accordingly, the controller may request that the user remove impurities stored in the filter assembly 5 (e.g., stop operation of the rotating shaft 611 of the motor 61) via an alarm device (e.g., a display device and/or a speaker) if the second magnetism sensor 75 does not sense the magnetism generator 71.

In the case of the filter assembly 5 having the above-described configuration, if the compressor 55 reciprocates within the housing 51 between the first reciprocation threshold position L1 and the second reciprocation threshold position L2, the racks 554 and 555 may be exposed to the outside of the housing 51.

This may restrict the size of the filter assembly 5 that is separably placed within the discharge duct 43. Therefore, the filter assembly 5 may further include a rack retraction preventing member 517.

Figure 8:
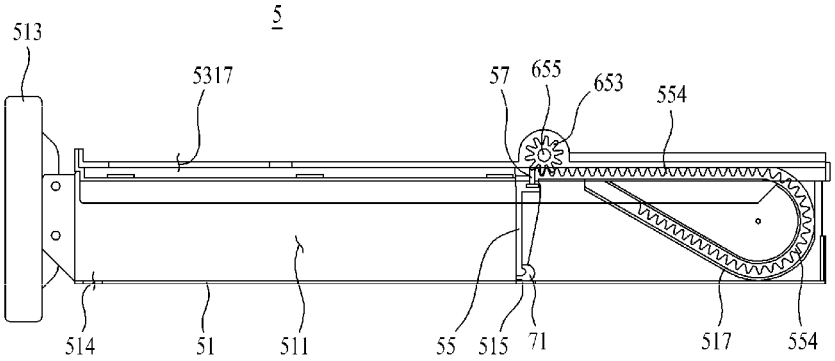
FIGS. 8(*a*) and 8(*b*) are views showing an example rack retraction preventing member included in the laundry treatment apparatus.
Figure 8:
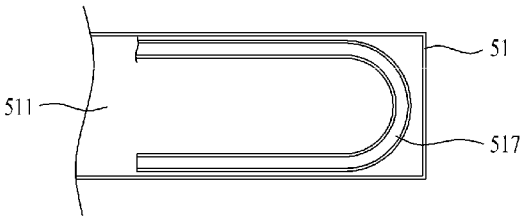

Referring to FIGS. 8(*a*) and 8(*b*), the rack retraction preventing member 517 is placed within the housing 51 and serves to prevent the racks 554 and 555 from being exposed to the outside of the housing 51 when the compressor 55 is moved to the second reciprocation threshold position L2.

More specifically, a pair of rack retraction preventing members 517 is provided respectively at opposite sides of the housing 51 to move the first rack 554 and the second rack 555 forward of the housing 51 after the first rack 554 and the second rack 555 are moved rearward of the housing 51.

To this end, the rack guide 59 may further include body through-holes (595, see FIG. 4) perforated in the guide body 591 for connection of the rack retraction preventing members 517.

The rack retraction preventing member 517, as shown in FIG. 8, may include a semicircular portion extending from the top to the bottom of the housing 51, and a linear portion extending from a lower end of the semicircular portion to the top of the housing 51 (see FIG. 8(*a*)).

Note that the linear portion may extend parallel to the bottom surface of the housing 51 toward the front surface of the housing 51 (see FIG. 8(*b*)).

Further, the filter assembly 5 is separable from the discharge duct 43, and thus may be moved within the discharge duct 43 during operation of the drive unit 6.

As the rack gear 65 disposed on the filter assembly 5 is engaged with the motor gear 63 located within the discharge duct 43, the impurity remover unit B may be moved within the housing 51.

Accordingly, the filter assembly 5 provided with the rack gear 65 may be moved upward and downward within the discharge duct 43 during rotation of the motor gear 63. Such movement of the filter assembly 5 within the discharge duct 43 may cause separation between the motor gear 63 and the rack gear 65 as well as generation of noise.

To address these issues, the laundry treatment apparatus 100 may further include a filter guide 433 configured to restrict (e.g., prevent) movement of the filter assembly 5 inserted in the discharge duct 43.

Figure 9:
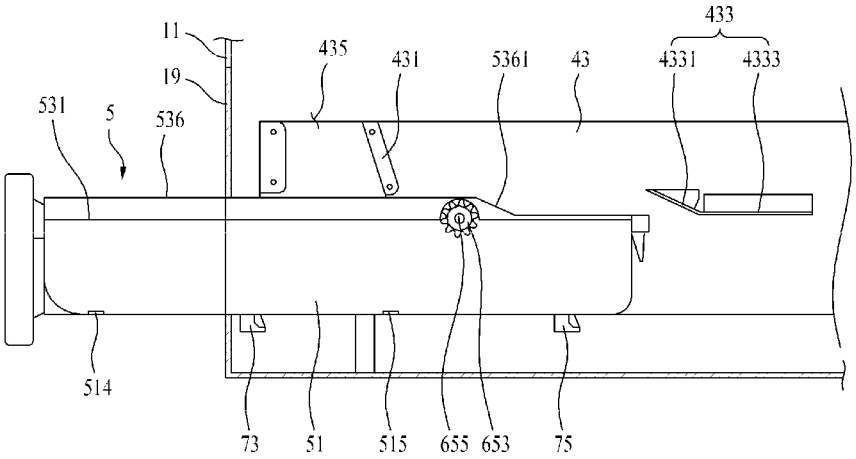
FIG. 9 is a view showing an example filter guide provided in a discharge duct to support a filter assembly.

As shown in FIG. 9, the filter guide 433 may be placed within the discharge duct 43 to support an upper surface of the filter assembly 5.

The filter assembly 5 may further include a frame guide 536 protruding from an upper surface of the filter frame 531 to extend in a longitudinal direction of the filter frame 531 (e.g., in a longitudinal direction of the discharge duct 43), and a guide slope 5361 formed at the frame guide 536 to connect an upper surface of the frame guide 536 and the upper surface of the filter frame 531 to each other.

In this case, the filter guide 433 may include a first guide 4331 configured to come into contact with the guide slope 5361, and a second guide 4333 configured to come into contact with the upper surface of the filter frame 531.

The first guide 4331 serves to prevent the filter assembly 5 from being moved rearward of the discharge duct 43 during rotation of the motor gear 63, and the second guide 4333 serves to restrict (e.g., prevent) the filter assembly 5 from being separated from the bottom surface of the discharge duct 43 during rotation of the motor gear 63.

In addition, the discharge duct 43 may be provided with the path guide 431 configured to guide air discharged from the connection duct 41 to the air introduction hole 5317 of the filter frame 531.

The path guide 431 extends from the bottom of the duct connection hole 435 of the discharge duct 43 toward the filter frame 531. The path guide 431 may be configured to come into contact with the frame guide 536.

This serves to allow the path guide 431 to restrict (e.g., prevent) the front surface of the filter assembly 5 from being separated from the bottom surface of the discharge duct 43 during rotation of the motor gear 63.

FIGS. 10 to 13 illustrate another example filter assembly included in the laundry treatment apparatus 100.

Figure 11:
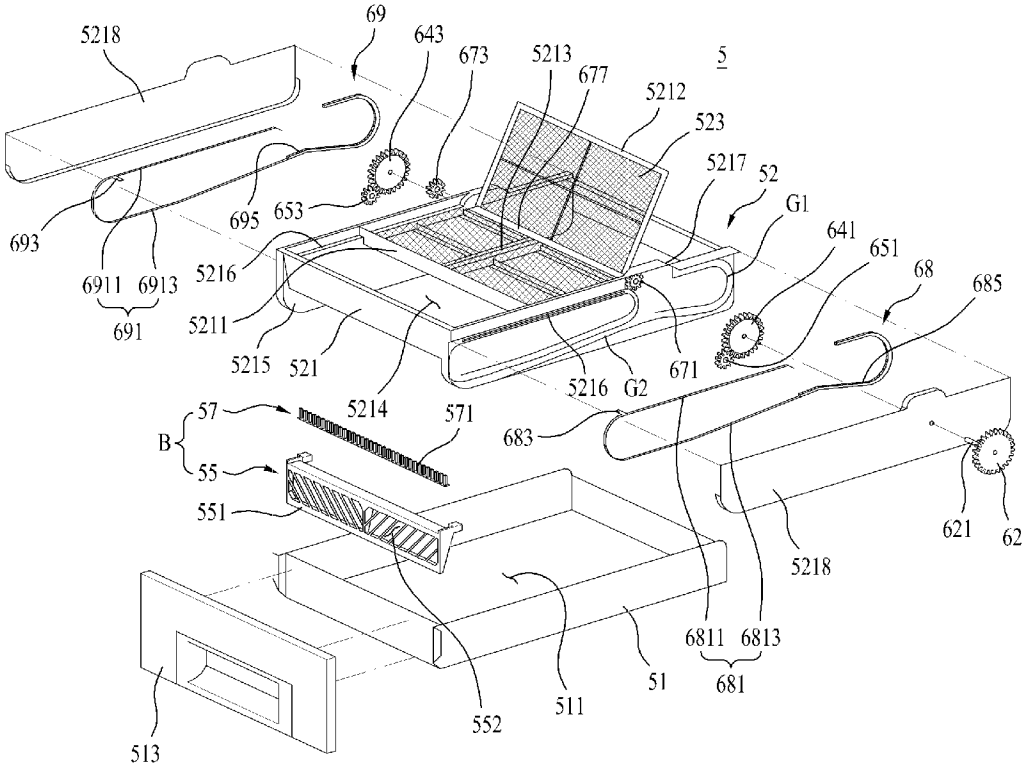

The filter assembly 5, as shown in FIG. 11, includes the housing 51 having the storage space 511 in which impurities are stored and the handle 513, a filter unit 52 disposed on the housing 51 to filter air to be moved from the interior of the housing 51 to the outside of the housing 51 (e.g., to the discharge duct 43), and the impurity remover unit B placed within the housing 51 (e.g., within the storage space 511) to separate impurities remaining on the filter unit 52 and compress the impurities separated from the filter unit 52 within the housing 51.

The filter unit 52 includes a filter frame 521 secured to the housing 51, and a filter 523 secured to the filter frame 521 to filter air.

The filter frame 521 is configured to receive an upper surface and both lateral surfaces of the housing 51. The filter frame 521 includes a first frame 5211 and a second frame 5212 to which the filter 523 is secured.

The first frame 5211 and the second frame 5212 are located at the open upper side of the housing 51. The second frame 5212 is rotatably coupled to the filter frame 521 and is separable from the housing 51.

Both the first frame 5211 and the second frame 5212 have holes to which the filter 523 is secured. A grid type rib (5213, filter support rib) is provided at the holes to support the filter 523.

The first frame 5211 has an air introduction hole 5214, through which air introduced into the discharge duct 43 is moved into the housing 51.

Accordingly, the air, introduced into the discharge duct 43 through the connection duct 41, is moved into the housing 51 through the air introduction hole 5214 by way of the path guide 431. Then, the air inside the housing 51 is filtered by the filter 523 while moving to the discharge duct 43.

The impurity remover unit B may include the compressor 55 placed within the housing 51 to compress impurities within the housing 51, and the brush 57 disposed on the compressor 55 to separate impurities remaining on the filter 523 from the filter 523.

The compressor 55 may include the compression plate 551 configured to reciprocate within the housing 51 via operation of the drive unit 6, and the plurality of through-holes 552 perforated in the compression plate 551.

In this case, the brush 57 may have the plurality of brush bosses 571 arranged on the upper surface of the compression plate 551 and spaced apart from one another by a predetermined distance.

The rib 5213 of the filter frame 521 may be provided with a scraper 525. The scraper 525 may serve to separate impurities from the brush bosses 571 and assist in moving the impurities into the storage space 511 of the housing 51.

Figure 10:
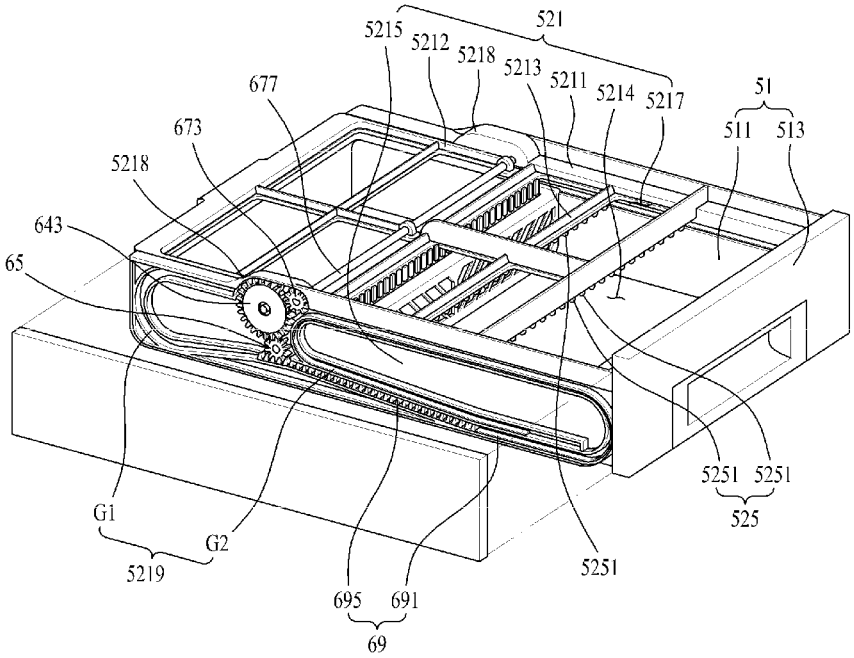
FIGS. 10 to 13 are views showing another example of a filter assembly included in the laundry treatment apparatus.

The scraper 525, as shown in FIG. 10, may have a plurality of scraper bosses 5251, which are formed at the rib 5213 and spaced apart from one another by a predetermined distance in a width direction of the housing 51.

The position relationship of the scraper bosses 5251 and the brush bosses 571 and the shape of the scraper bosses 5251 have been described above, and thus a detailed description thereof will be referenced, rather than repeated.

In some examples, two cover frames 5215 are provided at opposite ends of the filter frame 521 to receive opposite longitudinal surfaces of the housing 51.

Each of the cover frames 5215 has a connection plate slit 5216 perforated therein in a longitudinal direction of the housing 51. A cover 5218 is secured to the cover frame 5215 to define a predetermined space between the cover 5218 and the cover frame 5215.

Accordingly, the cover 5218 serves to prevent the connection plate slit 5216 from being exposed to the outside.

The connection plate slit 5216 serves to allow a rack connection plate 683 or 693, which serves to transmit power of the drive unit 6 to the compression plate 551, to penetrate the cover frame 5215. This will be described later in more detail.

The cover frame 5215 has a frame slope 5217 formed at an upper surface thereof. With provision of the frame slope 5217, a rear portion of the upper surface of the cover frame 5215 has a lower height than that of a front portion of the upper surface.

The filter guide 433 located within the discharge duct 43 is coupled to the frame slope 5217 and the rear portion of the upper surface of the cover frame 5215. This coupling restricts (e.g., prevents) the filter assembly 5 from being moved within the discharge duct 43 during operation of the drive unit 6. Functions of the frame slope 5217 and the filter guide 433 have been described above with reference to FIG. 9, and thus a detailed description thereof will be referenced, rather than repeated.

The impurity remover unit B is adapted to reciprocate within the housing 51 upon receiving power from the drive unit 6. Hereinafter, a configuration of the drive unit 6 will be described with reference to FIG. 11.

The drive unit 6 may include the motor 61 located at the exterior of the discharge duct 43, a motor gear 63 coupled to the rotating shaft 611 of the motor 61 and located within the discharge duct 43, a separable gear 62 rotatably secured to the cover 5218 and separably engaged with the motor gear 63, a first intermediate gear 641 located between the cover frame 5215 and the cover 5218 and connected to the separable gear 62, a first rack 68 located between the cover frame 5215 and the cover 5218 and connected to the compression plate 551, and a first rack gear 651 configured to connect the first rack 68 and the first intermediate gear 641 to each other.

Figure 13:
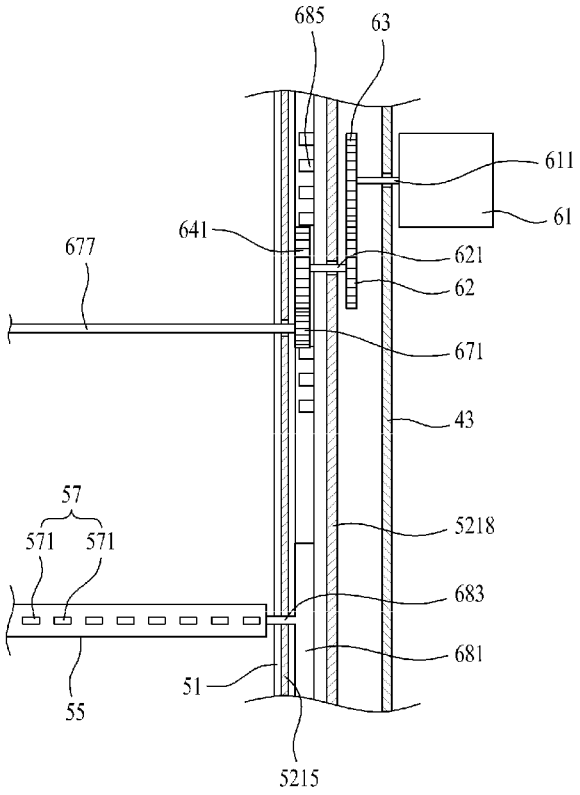

The motor 61, as shown in FIG. 13, is secured to the exterior of the discharge duct 43. The rotating shaft 611 of the motor 61 penetrates the discharge duct 43 and is coupled to the motor gear 63 located within the discharge duct 43.

A separable gear rotating shaft 621 coupled to the separable gear 62, as shown in FIG. 11, penetrates the cover 5218 and is coupled to the first intermediate gear 641. The first intermediate gear 641 is connected to the first rack 68 via the first rack gear 651 that is rotatably coupled to the cover frame 5215.

Accordingly, once the filter assembly 5 is inserted into the discharge duct 43, the separable gear 62 is engaged with the motor gear 63 to enable transmission of power from the motor 61 to the first rack 68.

Note that the first rack gear 651 may be omitted if the first intermediate gear 641 is directly engaged with the first rack 68.

To ensure that the compression plate 551 stably reciprocates within the housing 51, the drive unit 6 may further include a second rack 69 which is located between the cover frame 5215 and the cover 5218 and is secured to the compression plate 551.

In this case, the drive unit 6 may further include a second intermediate gear 643 connected to the first intermediate gear 641 via a connection gear, and a second rack gear 653 configured to connect the second intermediate gear 643 and the second rack 69 to each other.

The connection gear may include a first connection gear 671 which is provided at the cover frame 5215 and is coupled to the first intermediate gear 641, and a second connection gear 673 which is coupled to the first connection gear 671 via a connection shaft 677 and is coupled to the second intermediate gear 643.

The connection shaft 677 may be arranged in a width direction of the housing 51 and may penetrate both the cover frames 5215 provided respectively at opposite ends of the filter frame 521.

Accordingly, the connection shaft 677 may serve not only to connect the first connection gear 671 and the second connection gear 673 to each other, but also to rotatably secure the second frame 5212 to both the cover frames 5215.

The first connection gear 671 and the second connection gear 673 may be rotatably arranged above the first and second intermediate gears 641 and 643 respectively, and the first rack gear 651 and the second rack gear 653 may be rotatably secured to the respective cover frames 5215 and located below the first and second intermediate gears 641 and 643 respectively.

The first rack 68 and the second rack 69 are respectively secured to opposite ends of the compression plate 551 via the connection plates 683 and 693 penetrating the connection plate slits 5216. The first rack 68 and the second rack 69 are moved in a space between the cover frame 5215 and the cover 5218 via operation of the motor 61, which allows the impurity remover unit B to reciprocate within the housing 51.

The first rack 68 includes a first rack body 681 in the form of a bar, a first geared portion 685 formed at a surface of the first rack body 681 and engaged with the first rack gear 651, and the first connection plate 683 formed at the first rack body 681 and inserted into the connection plate slit 5216 to thereby be secured to the compression plate 551. The first geared portion 685 is located only at a partial region of the first rack body 681.

The second rack 69 includes a second rack body 691 in the form of a bar, the second connection plate 693 formed at the second rack body 691 and inserted into the connection plate slit 5216 to thereby be secured to the compression plate 551, and a second gear portion 695 located only at a partial region of the second rack body 691 and engaged with the second rack gear 653.

In this case, the cover frame 5215 may further include a rack guide 5219 configured to guide movement of the rack 68 or 69.

Figure 12:
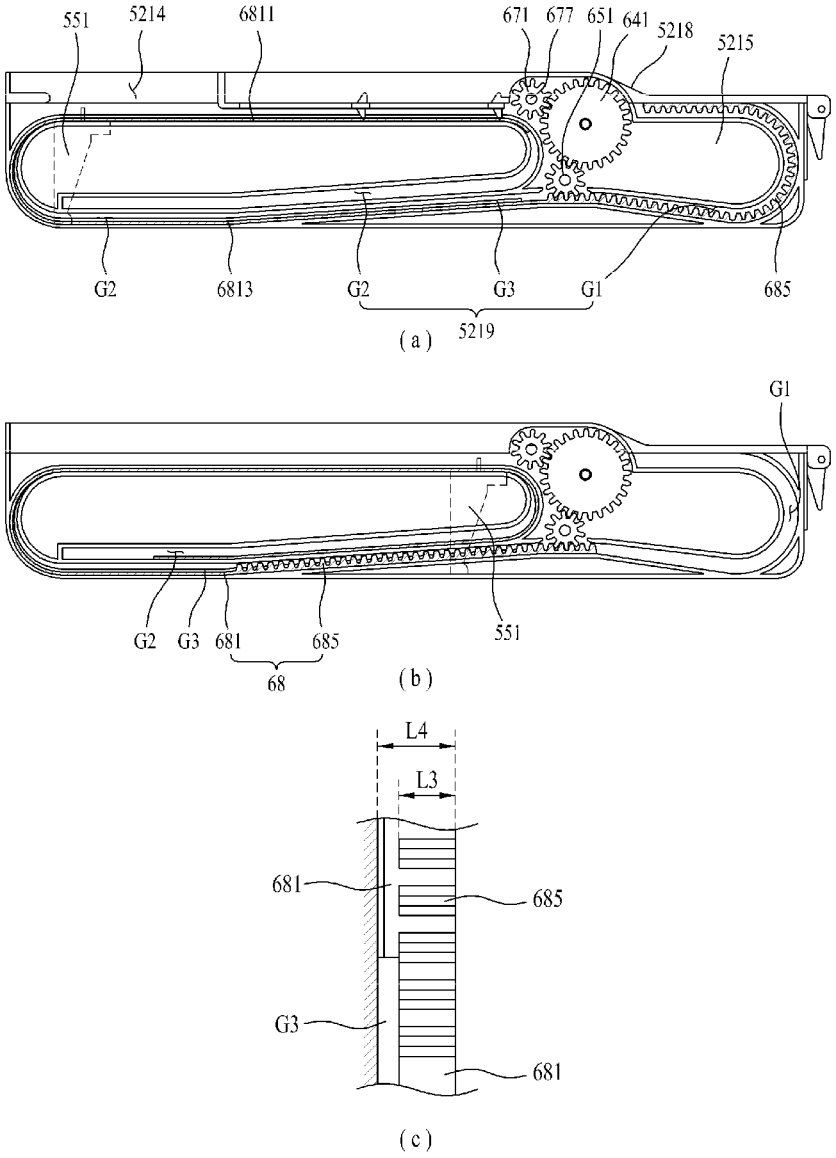

As shown in FIGS. 12(*a*) to (*c*), the rack guide 5219 may include a rack body receiving portion G2 in which the rack body 681 or 691 is received, and a gear receiving portion G1 in which the geared portion 685 or 695 is received, the gear receiving portion G1 extending from the rack body receiving portion G2.

In this case, the rack body receiving portion G2 may be located below the connection plate slit 5216 (e.g., at a position spaced apart from the connection plate slit 5216 by a distance equal to or less than the thickness of the rack body 681 or 691) to ensure that the connection plate slit 5216 is covered by the rack body 681 or 691 when the compression plate 551 reciprocates within the housing 51.

This arrangement may reduce malfunction of the drive unit 6 caused when impurities within the housing 51 are moved to the cover frame 5215 through the connection plate slit 5216.

As described above, since the connection plate slit 5216 is perforated in the cover frame 5215, there is risk of impurities within the housing 51 being moved to the cover frame 5215 through the connection plate slit 5216 in a state in which the connection plate slit 5216 is open, thereby preventing rotation of the gears 641, 643, 651, 653, 671, and 673.

However, the filter assembly 5 may address this issue as the rack body 681 or 691 closes the connection plate slit 5216 regardless of a position of the compression plate 551 within the housing 51.

More specifically, the rack body 681 or 691 may be divided into a front body 6811 or 6911 and a rear body 6813 or 6913 on the basis of the connection plate 683 or 693, and the length of the front body 6811 or 6911 may be greater than the length of the connection plate slit 5216.

The rack body receiving portion G2 extends from a lower portion of the cover frame 5215 to an upper portion of the cover frame 5215 where the connection plate slit 5216 is formed. An end of the rack body receiving portion G2 located in the lower portion of the cover frame 5215 is connected to the gear receiving portion G1.

The gear receiving portion G1 extends from the lower portion of the cover frame 5215 to the upper portion of the cover frame 5215. The rack gear 651 or 653 is located at the junction of the gear receiving portion G1 and the rack receiving portion G2.

In addition, a rack body support portion G3 configured to support an upper surface of the rack body 681 or 691 may further be formed within the rack body receiving portion G2.

As shown, the rack body 681 or 691 is moved in the rack body receiving portion G2 as the geared portion 685 or 695 is engaged with the rack gear 651 or 653. In this case, the rack body 681 or 691 may bend in the rack body receiving portion G2, thus blocking the rack body receiving portion G2 due to a height difference between the rack body 681 or 691 and the geared portion 685 or 695.

The rack body support portion G3 serves to address this issue.

To this end, the geared portion 685 or 695 may be spaced apart from one end of the rack body 681 or 691 by a distance equal to the length of the rack body support portion G3.

That is, a width L3 of the geared portion 685 or 695 may be less than a width L4 of the rack body 681 or 691, in order to prevent the geared portion 685 or 695 from interfering the rack body support portion G3 even if the geared portion 685 or 695 is moved into the rack body receiving portion G2.

Moreover, a partial region of a space provided by the gear receiving portion G1 where the rack gear 651 or 653 is located may have the same height as that of the geared portion 685 or 695, but the remaining region of the space may have a greater height that that of the geared portion 685 or 695.

The geared portion 685 or 695 is engaged with the rack gear 651 or 653 in a connection region of the gear receiving portion G1 and the rack body receiving portion G2 because minimizing interference between the geared portion 685 or 695 and the gear receiving portion G1 in the remaining region may be advantageous in terms of movement of the rack 68 or 69.

The position sensing unit may be provided to measure the quantity of impurities stored in the housing 51.

The position sensing unit may include the magnetism generator secured to the compression plate 551, the first magnetism sensor secured within the discharge duct 43 at the first reciprocation threshold position L1, and the second first magnetism sensor secured within the discharge duct 43 at the second reciprocation threshold position L2, In this case, the housing 51 may further have the first hole perforated in the housing 51 defining the storage space 511 to allow the first magnetism sensor to sense the magnetism generator and the second hole formed to allow the second magnetism sensor to sense the magnetism generator.

Figure 14:
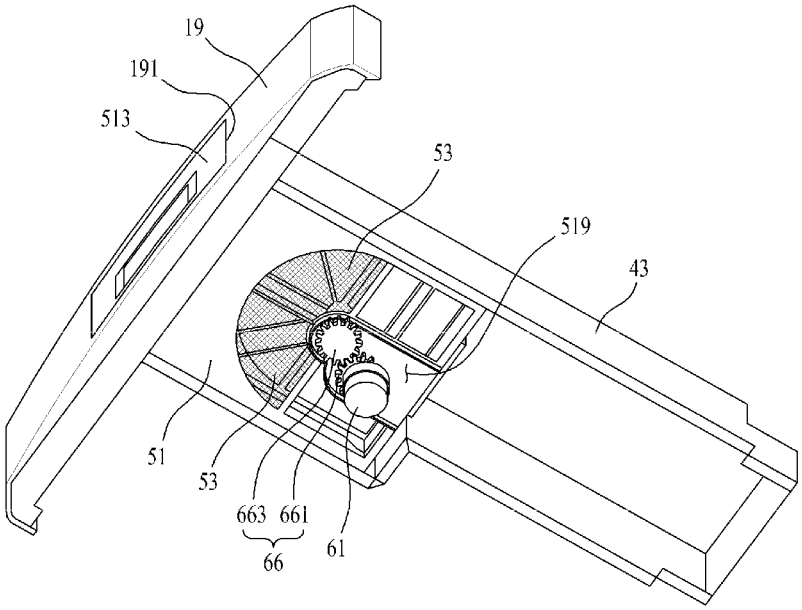
FIGS. 14 and 15 are views showing a further example of a filter assembly included in the laundry treatment apparatus.
Figure 15:
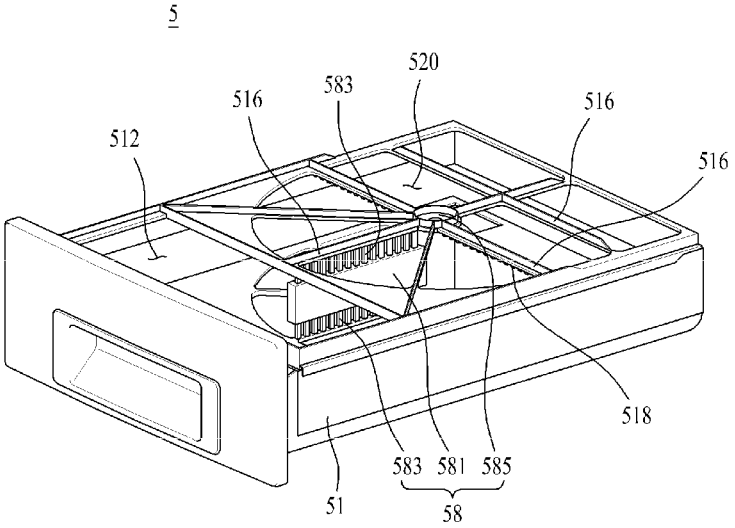

FIGS. 14 and 15 illustrate another example filter assembly included in the laundry treatment apparatus.

The filter assembly 5 includes the housing 51 in which impurities are stored, the housing 51 being separable from the discharge duct 43 through the filter insertion hole 191 of the filter support panel 19, the filter unit 53 configured to filter air introduced into the housing 51, and an impurity remover unit 58 rotatably placed within the housing 51, the impurity remover unit 58 serving to remove impurities from the filter unit 53 and to compress the impurities separated from the filter unit 53 within the housing 51.

As shown in FIG. 15, the housing 51 may be a hexahedral housing defining a storage space. The handle 513 is provided at the front surface of the housing 51, and the air introduction hole 512 is formed in the upper surface of the housing 51 such that air introduced into the discharge duct 43 is moved into the housing 51 through the air introduction hole 512.

A plurality of housing through-holes 520 is formed in the upper surface and the bottom surface of the housing 51 to communicate the interior of the housing 51 with the exterior of the housing 51 (e.g., the interior of the discharge duct 43). The filter unit 53 is secured to the housing through-holes 520.

A plurality of filter support ribs 516 configured to support the filter unit 53 may be provided at the housing through-holes 520.

The impurity remover unit 58 may include a brush frame 581 rotatably secured within the housing 51 via a brush rotating shaft 585, and a brush 583 provided at an outer peripheral surface of the brush frame 581 to come into contact with the filter unit 53.

The brush 583 may have a plurality of bosses (e.g., brush bosses) protruding from the outer peripheral surface of the brush frame 581 to come into contact with the filter unit 53. Accordingly, the brush 583 may separate impurities remaining on the filter unit 53 from a surface of the filter unit 53 during rotation of the brush frame 581.

In this case, the filter support rib 516 may be provided with a scraper 518, which comes into contact with the brush 583 to separate impurities from the brush 583 during rotation of the brush frame 581.

The scraper 518 may have a plurality of bosses (e.g., scraper bosses) protruding from the filter support rib 516. The respective brush bosses may be arranged to pass each space between adjacent scraper bosses.

The brush frame 581 is rotated within the housing 51 by the drive unit 6 that is provided at the exterior of the housing 51. The drive unit 6 may include the motor 61 secured to the discharge duct 43 and the gear 66 configured to transmit power of the motor 61 to the brush frame 581.

The motor 61 may be secured to the exterior of the discharge duct 43. In this case, a rotating shaft of the motor 61 may penetrate the discharge duct 43.

The gear 66, as shown in FIG. 14, may include a driving gear 661 (e.g., motor gear) secured to the rotating shaft of the motor 61 and located within the discharge duct 43, and a driven gear 663 coupled to the brush rotating shaft 585 and located at the outside of the housing 51.

Accordingly, if the controller operates the motor 61, the driving gear 661 and the driven gear 663 are rotated, and the brush frame 581 secured to the brush rotating shaft 585 is rotated within the housing 51 via rotation of the driven gear 663.

Note that the controller may rotate the motor 61 forward or in reverse to allow the brush frame 581 to reciprocate over a predetermined interior region of the housing 51.

If the brush frame 581 reciprocates within the housing 51, the brush 583 may separate impurities from the surface of the filter unit 53. The impurities separated from the surface of the filter unit 53 may be compressed in one side of the housing 51 by the brush frame 581.

In addition, a gear receiving recess 519 in which the driving gear 661 and the driven gear 663 are received may further be formed in the outer peripheral surface of the housing 51. The gear receiving recess 519 serves to prevent the gear 66 from protruding from the outer peripheral surface of the housing 51, thereby protecting the gear 66 when the filter assembly 5 is inserted into or retracted from the discharge duct 43.

As is apparent from the above description, a laundry treatment apparatus may increase the filtration capacity of a filter.

Further, a laundry treatment apparatus may provide a configuration to increase the quantity of hot air to be supplied into a drum in which laundry is received and to increase the filtration capacity of a filter, thereby being usable as a commercial drying machine.

Furthermore, a laundry treatment apparatus may judge whether or not a filter is mounted in the laundry treatment apparatus and judge the quantity of impurities remaining on the filter.

In addition, a laundry treatment apparatus may inform a user of a cleaning time of a filter based on the quantity of impurities remaining on the filter.

It will be apparent that, although examples have been shown and described above, the disclosure is not limited to the above-described examples, and various modifications and variations can be made by those skilled in the art without departing from the spirit and scope of the appended claims. Thus, it is intended that the modifications and variations are part of the disclosure and covered by the appended claims.

What is claimed is:

1. A laundry treatment apparatus comprising:

a cabinet defining an external appearance of the laundry treatment apparatus;

a drum rotatably supported within the cabinet and configured to receive laundry therein;

a connection duct into which air inside the drum is discharged;

a discharge duct that extends in a longitudinal direction of the drum and that is connected to the connection duct;

a filter assembly including:

a filter unit located in the discharge duct and configured to filter air, and an impurity remover unit configured to remove impurities remaining on the filter unit and compress impurities removed from the filter unit; and a drive unit configured to reciprocate the impurity remover unit along the filter unit, wherein the filter unit is extended in the longitudinal direction of the drum.

2. The apparatus according to claim 1, wherein the cabinet has a filter insertion hole that communicates with the discharge duct, and wherein the filter assembly passes through the filter insertion hole based on the filter assembly being inserted into the discharge duct or separated from the discharge duct.

3. The apparatus according to claim 2, wherein the filter assembly further includes a housing in which the impurity remover unit is received, the housing being configured to store impurities removed from the filter unit by the impurity remover unit, and wherein the filter unit includes:

a filter frame located at an upper side of the housing;

an air introduction hole defined in the filter frame and configured to allow air introduced into the discharge duct to be introduced into the housing; and a filter attached to the filter frame and configured to filter air moving from the housing to the discharge duct.

4. The apparatus according to claim 3, wherein the impurity remover unit includes:

a compressor located within the housing and configured to compress impurities within the housing by reciprocating within the housing based on force generated by the drive unit; and a brush secured to the compressor and configured to separate, from the filter, impurities remaining on the filter.

5. The apparatus according to claim 4, wherein the impurity remover unit further includes a rack arranged in a longitudinal direction of the housing and connected to the compressor, and wherein the drive unit includes a rack gear rotatably coupled to the filter frame and engaged with the rack, and a motor gear located in the discharge duct and separably coupled to the rack gear.

6. The apparatus according to claim 5, wherein the filter assembly further includes a rack retraction preventing member located in the housing and configured to guide the rack in a manner that prevents the rack from being retracted outward from the housing during movement of the compressor.

7. The apparatus according to claim 5, wherein the rack includes a first rack and a second rack respectively provided at opposite ends of the compressor, wherein the rack gear includes a first rack gear rotatably supported at the filter frame and engaged with the first rack, a second rack gear rotatably supported at the filter frame and engaged with the second rack, and a connection shaft configured to connect the first rack gear and the second rack gear to each other, and wherein the motor gear is secured to a motor rotating shaft that is rotated by a motor, the motor being located at an exterior of the discharge duct and the motor gear being located within the discharge duct.

8. The apparatus according to claim 7, wherein the filter frame includes:

a first frame having the air introduction hole; and a second frame rotatably coupled to the first frame via the connection shaft, the second frame being separable from the housing.

9. The apparatus according to claim 4, wherein the compressor includes:

a compression plate configured to reciprocate within the housing, the brush being secured to the compression plate; and a plurality of through-holes perforated in the compression plate.

10. The apparatus according to claim 4, wherein the filter assembly further includes a scraper located at the filter frame and configured to separate impurities from the brush.

11. The apparatus according to claim 10, wherein the filter assembly further includes a rib configured to support the filter, wherein the scraper has a plurality of scraper bosses protruding from the rib and spaced apart from one another by a predetermined distance, and wherein the brush has a plurality of brush bosses protruding from the compressor toward the filter and spaced apart from one another by a predetermined distance.

12. The apparatus according to claim 11, wherein the plurality of brush bosses pass through spaces between adjacent scraper bosses.

13. The apparatus according to claim 1, further comprising a position sensing unit configured to sense a position of the impurity remover unit.

14. The apparatus according to claim 13, wherein the position sensing unit includes:

a magnetism generator secured to the impurity remover unit; and a magnetism sensor configured to generate a control signal based on the magnetism generator reaching a preset position.

15. The apparatus according to claim 14, wherein the filter assembly further includes a housing in which the impurity remover unit is received such that impurities, removed from the filter unit by the impurity remover unit, are stored in the housing, a first hole perforated in a bottom surface of the housing, and a second hole perforated in the bottom surface of the housing and spaced apart from the first hole by a predetermined distance, and wherein the magnetism sensor is a first magnetism sensor secured within the discharge duct at a position below the first hole, the apparatus further comprising:

a second magnetism sensor secured within the discharge duct at a position below the second hole.

16. The apparatus according to claim 3, wherein the discharge duct includes a path guide configured to guide air discharged from the connection duct to the air introduction hole, and wherein the filter assembly further includes a frame guide that protrudes from an upper surface of the filter frame and contacts the path guide.

17. The apparatus according to claim 16, wherein the filter assembly further includes a guide slope configured to connect an upper surface of the frame guide and the upper surface of the filter frame to each other, and wherein the discharge duct further includes a first duct guide configured to contact the guide slope and a second duct guide configured to contact the upper surface of the filter frame based on the filter assembly being inserted into the discharge duct.

18. The apparatus according to claim 1, wherein the cabinet includes a rear panel having an air outlet through which air, discharged from the drum through the discharge duct, is discharged to outside of the cabinet, and a base panel located below the drum, the rear panel being secured to the base panel, and wherein the base panel has a duct guide configured to guide positioning of the discharge duct in a manner that facilitates coupling of the discharge duct to the air outlet.

19. The apparatus according to claim 18, wherein the duct guide includes:

at least one position guide configured to guide both lateral sides of the discharge duct to coincide with both lateral sides of the air outlet; and at least one height guide configured to guide a top and bottom of an outer peripheral surface of the discharge duct to coincide with a top and bottom of an outer periphery of the air outlet.

20. The apparatus according to claim 19, wherein each of the at least one position guide and the at least one height guide includes a first plate and a second plate extending perpendicular to the first plate, the second plate having a slope, and wherein the at least one position guide includes at least one pair of position guides each secured to the base panel via the second plate, and the at least one height guide is secured to the base panel via the first plate.

21. The apparatus according to claim 4, wherein the filter unit further includes:

two cover frames extending from opposite ends of the filter frame and configured to receive opposite surfaces of the housing; and covers located respectively at the cover frames and each being configured to define a predetermined space between the cover frame and the cover.

22. The apparatus according to claim 21, wherein the filter unit further includes a connection plate slit in each of the cover frames that extends in a longitudinal direction of the housing, and wherein the drive unit includes:

a first rack and a second rack, each of which is secured to the compressor through the connection plate slit and located in a space between the cover frame and the cover;

a first intermediate gear rotatably coupled to a first cover frame and configured to reciprocate the first rack in a longitudinal direction of the housing and a second intermediate gear rotatably coupled to a second cover frame and configured to reciprocate the second rack in a longitudinal direction of the housing;

a separable gear rotatably coupled to a first cover and configured to penetrate the first cover to thereby be engaged with the first intermediate gear;

a connection shaft penetrating the first and second cover frames, a first connection gear located on the connection shaft and engaged with the first intermediate gear, and a second connection gear located on the connection shaft and engaged with the second intermediate gear;

a motor secured to an exterior of the discharge duct and having a rotating shaft penetrating the discharge duct; and a motor gear secured to the rotating shaft and located within the discharge duct, the separable gear being connected to the motor gear.

23. The apparatus according to claim 22, wherein the drive unit further includes:

a first rack gear rotatably coupled to the first cover frame and configured to connect the first intermediate gear and the first rack to each other; and a second rack gear rotatably coupled to the second cover frame and configured to connect the second intermediate gear and the second rack to each other.

24. The apparatus according to claim 23, wherein the first rack and the second rack have a same configuration, wherein the first rack includes:

a rack body having a shape of a bar;

a geared portion protruding from a surface of the rack body and engaged with the first rack gear; and a connection plate located at the rack body and configured to be inserted into the connection plate slit to thereby be coupled to the compressor.

25. The apparatus according to claim 24, wherein the filter unit further includes a rack guide provided at each of the first and second cover frames and configured to guide movement of the first rack or the second rack.

26. The apparatus according to claim 25, wherein the rack guide includes:

a rack body receiving portion in which the rack body is received, the rack body receiving portion extending from a bottom of the connection plate slit to a lower portion of the cover frame; and a gear receiving portion in which the geared portion is received, the gear receiving portion extending from the rack body receiving portion toward an upper portion of the cover frame.

27. The apparatus according to claim 26, wherein the rack body receiving portion extends in a longitudinal direction of the connection plate slit and is spaced apart from the connection plate slit by a distance equal to or less than a thickness of the rack body.

28. The apparatus according to claim 26, wherein the rack guide further includes a rack body support portion located within the rack body receiving portion and configured to contact an upper surface of each rack body.

29. The apparatus according to claim 2, wherein the filter assembly includes:

a housing having a storage space configured to store impurities;

an air introduction hole perforated in the housing, through which air introduced into the discharge duct is introduced into the storage space through the air introduction hole; and a housing through-hole perforated in the housing, the filter unit being located at the housing through-hole, and wherein the impurity remover unit is rotatably supported within the housing and is configured to separate, from the filter unit, impurities remaining on the filter unit and to compress impurities separated from the filter unit within the housing.

30. The apparatus according to claim 29, wherein the impurity remover unit includes:

a brush frame located within the housing and configured to reciprocate over a predetermined area of the filter unit, the brush frame compressing impurities within the housing;

a brush located at the brush frame and configured to contact the filter unit; and a brush rotating shaft configured to rotatably secure the brush frame to the housing.

31. The apparatus according to claim 30, wherein the drive unit includes:

a motor secured to the discharge duct;

a driving gear coupled to a rotating shaft of the motor and located within the discharge duct; and a driven gear provided on the brush rotating shaft and located at an exterior of the housing so as to be engaged with the driving gear.

* * * * *